US009375786B2

(12) United States Patent
Michelitsch

(10) Patent No.: US 9,375,786 B2
(45) Date of Patent: Jun. 28, 2016

(54) REFRACTORY CERAMIC SLIDE PLATE AND ASSOCIATED SLIDE PLATE SET

(75) Inventor: Andreas Michelitsch, Kumberg (AT)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 209 days.

(21) Appl. No.: 14/125,365

(22) PCT Filed: Jun. 27, 2012

(86) PCT No.: PCT/EP2012/062516

§ 371 (c)(1),
(2), (4) Date: Dec. 11, 2013

(87) PCT Pub. No.: WO2013/007526

PCT Pub. Date: Jan. 17, 2013

(65) Prior Publication Data

US 2014/0124546 A1 May 8, 2014

(30) Foreign Application Priority Data

Jul. 8, 2011 (EP) ..... 11173215

(51) Int. Cl.

| | |
|---|---|
| ***B22D 41/08*** | (2006.01) |
| ***B22D 41/28*** | (2006.01) |
| ***B22D 41/24*** | (2006.01) |

(52) U.S. Cl.

CPC ..... *B22D 41/28* (2013.01); *B22D 41/24* (2013.01)

(58) Field of Classification Search

CPC ..... B22D 41/24
USPC ..... 222/600
See application file for complete search history.

(56) References Cited

U.S. PATENT DOCUMENTS

| | | | | |
|---|---|---|---|---|
| 1,507,852 | A * | 9/1924 | Pleukharp | B22D 41/26 222/560 |
| 3,352,465 | A * | 11/1967 | Shapland | B22D 41/24 222/561 |
| 4,966,315 | A | 10/1990 | Tinnes et al. | |
| 5,173,198 | A | 12/1992 | Blum | |

FOREIGN PATENT DOCUMENTS

| | | | |
|---|---|---|---|
| CA | 1200384 | A1 | 2/1986 |
| DE | 10324801 | A1 | 1/2005 |
| EP | 0356551 | A1 | 3/1990 |
| EP | 0373287 | A2 | 6/1990 |
| EP | 0462478 | A1 | 12/1991 |
| EP | 1046447 | A1 | 10/2000 |
| WO | 8902801 | A1 | 4/1989 |
| WO | 0168296 | A1 | 9/2001 |
| WO | 2004105981 | A1 | 12/2004 |

* cited by examiner

*Primary Examiner* — Scott Kastler
(74) *Attorney, Agent, or Firm* — Medley, Behrens & Lewis, LLC

(57) ABSTRACT

The invention relates to a refractory ceramic slide plate and an associated slide plate set.

3 Claims, 8 Drawing Sheets

REFRACTORY CERAMIC SLIDE PLATE AND ASSOCIATED SLIDE PLATE SET

TECHNICAL FIELD

The invention relates to a refractory ceramic sliding plate and a corresponding sliding plate set.

BACKGROUND

A single sliding plate, or a so called sliding plate set, are parts of a sliding closure (sliding system, sliding gate) for the regulation/control of the outflow volume and the outflow speed of a metal melt from a metallurgic vessel, for example a ladle or a tundish.

Sliding plate systems of the named type comprise so called linear sliders and rotary sliders. They can comprise two or more plates. At least one of the plates is movable (at a linear slider: linearly movable; at a rotary slider: rotationally movable). Each plate features two main surfaces, which run parallel to each other, and at least one opening, each, which extends between the two main surfaces, so perpendicular to the main surfaces.

Through displacement of the movable plate (hereafter called sliding plate), corresponding openings of the plates can be arranged offset, partially overlapping or aligned with each other in order to adjust the mass and speed of the melt that is led through or to interrupt the stream of melt.

All plates consist of a fireproof ceramic material, which is able to resist the high temperatures of the metal melt (for example 1,500° C.). Especially during the opening and closing of the sliding closure, strong signs of corrosion show up on the fireproof material.

The EP 0 373 287 A2 describes a sliding plate, which features multiple discharge openings, so that the sliding plate can still be used when the first discharge opening is worn out, by using the second discharge opening for the regulation of the sliding closure.

Alternatively, the DE 103 24 801 A1 suggests to design the discharge openings of the sliding plates with different diameters so that depending to the use of one or the other discharge opening, more or less metal melt can flow through the control valve (the sliding closure).

SUMMARY

The invention underlies the task (object) to present a sliding plate which allows an optimized stream of the metal melt which is led through it.

Based on the previously named, known sliding plate with the following characteristics:

two main surfaces running parallel to each other, at least two discharge openings, arranged at a distance to each other, which extend between the main surfaces, wherein in the area of at least one main surface, at least two discharge openings feature different cross-sectional areas. The inventive idea lies in designing the sliding plate in such a way that: the shortest distance of two neighbouring/adjacent discharge openings along the main surface is smaller than the largest axis (chord) of both discharge openings.

The shortest distance between two circular openings is the distance along a straight line, which runs through the centres of the openings. This straight will often define the direction of displacement (direction of sliding) of the sliding plate at a linear slider.

The term "direction of displacement of the sliding plate" is generally a straight at a linear slider, at a rotary slider the direction of displacement runs along an arc.

Due to the dimensioning according to the invention (arrangement) of adjacent discharge openings of the sliding plate, different settings of the sliding closure are possible altogether. This is explained with the help of a 2 plate sliding closure in the following. It is understood, that the characteristics described therein are also valid for sliding closures with more than two plates.

a) one discharge opening of the sliding plate is aligned with one discharge opening of the further plate. That means that the discharge openings of both plates feature an identical cross sectional area. The discharge flow volume is at its maximum.

b) If the sliding plate according to example a) is moved, the common cross sectional area of the discharge openings of both plates in reduced and therefore also the discharge flow volume.

c) If the sliding plate is further moved, until a second discharge opening of the sliding plate is in a fluidic connection with the discharge opening of the further plate, a discharge flow profile with two partial streams in created until one of the openings of the sliding plate no longer has an overlap with the opening of the further plate.

While the measures according to a) and b) can also be performed at sliding closures according to the initially mentioned state of the art, the main advantage of the solution according to the invention lies in the fact (c) that at least two discharge openings of the sliding plate according to the invention can also simultaneously be brought into fluidic connection with a discharge opening of a further plate of the sliding closure. In doing so, the stream of melt is divided into at least two partial streams. A first partial stream flows through the discharge opening of the further plate of the sliding closure and afterwards through a part of the first discharge opening, while a second partial stream also flows through the discharge opening of the further (mostly fixed) plate of the sliding closure and afterwards through at least a segment of the second discharge opening of the sliding plate.

By means of this division, the flow speed of the partial streams as well as the total mass of the melt that is led through can be controlled (adjusted) to a certain extend. In doing so a characteristically different flow pattern is created. The following figure description is referred to.

The main characteristic of the sliding plate therefore lies in the fact. to enable an optimized regulation/control with less wear via at least one second pouring hole (a second discharge opening), which can be arranged at least partially parallel to the first pouring hole in a fluidic manner.

At a strong restriction (reduction of the stream of melt), the main part of the pouring stream can be poured out via a small discharge opening, which is completely brought under the discharge opening of the corresponding (further) plate of the sliding closure. The larger discharge opening can serve the fine adjustment of the flow volume of the metal melt together with the further opening, depending to what extend it is additionally brought into a fluidic connection with the discharge opening of the further plate(s).

A reduced amount of melt, which flows through a reduced discharge opening in the previously described constellation, only causes lighter erosion/corrosion.

Further, the risk of sucking in air in the area of the sliding closure is reduced, as long as the pouring process mainly takes place via the smaller discharge opening and only segments of the larger discharge opening are also in a fluidic connection with the discharge opening of the corresponding plate. This is due to the fact that the melt stream through the smaller discharge opening then takes place centrally (for example coaxially) in relation to the discharge opening of the further plate, In other words: in this position the discharge opening of the sliding plate always features a distance to the limiting wall of the discharge opening of the corresponding (mainly fixed) plate. This is also revealed in the following description of the drawing.

The aforementioned principle is analogously valid for sliding plates with more than 2 discharge openings, for example with 3 or 4 openings.

According to one embodiment, the shortest distance of two neighbouring discharge openings (along the corresponding main surface) is equal to 0.01 to 0.5 times of the largest axis/chord of both discharge openings.

According to one embodiment this distance can be limited to a lower limit of 0.05 and/or an upper limit of 0.35.

An alternative limit lies at 0.1, and a further possible upper limit at 0.25 or at 0.30.

One embodiment of the invention suggests that in the area of at least one main surface the sum of the cross-sectional area of the discharge opening with a small cross sectional area and the cross sectional area of the discharge opening with a large cross sectional area times x is larger or equal to the cross sectional area of the discharge opening with a large cross section, while x is ≥0.4 and ≤0.95, especially ≤0.9, ≤0.8, or rather ≤0.7 or ≤0.6 with a lower limit at ≥0.45, ≥0.5 or ≥0.55.

The previous calculation can be displayed as a formula as follows:

$$QS20 \geq QS10(1-x).$$

In doing so, QS20 relates to the cross sectional area of the discharge opening with a small cross sectional area and QS10 to the cross sectional area of the discharge opening with a large cross sectional area.

In case of two circular openings, appropriate lower limits for x can be set as 0.10; 0.20 or 0.25 and appropriate upper limits for x as 0.90; 0.80 or 0.70, while QS defines the corresponding diameter of the circle.

In case of more than two discharge openings, the following is valid:

$$\Sigma QS20 \geq QS10(1-x)$$

Where ΣQS20 comprises the cross sections of the discharge openings, which can at the same time, with the discharge opening with a large cross section (QS10), be brought into a fluidic connection with a discharge opening of a neighbouring plate, where ΣQS20 does not include QS10.

It is not definitely necessary that the discharge opening(s) feature a circular cross section, although this is preferred. Generally the discharge opening can feature an arbitrary geometrical cross section, for example rectangular or polygonal.

Usually the cross sectional area of the discharge opening is constant between the main surfaces so that in case of a circular cross section a cylindrical discharge opening is formed. However, the invention is not limited to such embodiment. It respectively also includes discharge openings, that feature a funnel-shaped profile for example.

The centres of the discharge openings along a main surface can lie on a common straight in case of a linear sliding closure, and on a common arc in case of a rotary sliding closure. These specifications are not exactly to be understood in a mathematical way, but in a technical way, for example with consideration to production tolerances. They can also be placed offset in the sliding direction, as shown in the following embodiment.

As mentioned the invention relates as well to a complete sliding plate set (a complete sliding closure), which correspondingly consists of at least one sliding plate of the previously named type and at least one further plate, wherein corresponding plates are aligned against each other with their corresponding main surfaces in their functioning/functional position. At the same time, the at least one further plate features at least one discharge opening, whose cross sectional area and arrangement are chosen in such a way that it covers one or more discharge openings of the sliding plate fully and/or partially, depending on the position of the sliding plate.

It is obvious that the sliding plate as well as the further plate(s) can be designed according to the state of art, regarding their material, or rather their assembly (for example in a metal envelope/cartridge).

According to one embodiment, the further plate features at least one discharge opening, whose cross sectional area and arrangement are chosen in such a way, that depending on the position of the sliding plate, it a) Only covers the discharge opening of the sliding plate with a small cross sectional area or b) covers the discharge opening of the sliding plate with a small cross sectional area and at the same time up to 50% of the discharge opening of the sliding plate with a large cross sectional area, or c) covers just the discharge opening of the sliding plate with a large cross sectional area.

The value 50% can be extended to 60%, however smaller values ≤45%, ≤40%, ≤30%) are preferred, so that as much melt as possible flows through the smaller opening.

The centres of all discharge openings preferably lie along corresponding main surfaces on a common level, which runs perpendicular to the main surfaces. This is valid for a linear sliding closure.

In case of a rotary sliding closure, the centres of all discharge openings lie along corresponding main surfaces in a common cylinder coat surface, which runs perpendicular to the main surfaces.

BRIEF DESCRIPTION OF THE DRAWINGS

Further features of the invention derive from the features of the sub-claims and the other application documents. Individual features may be realized as such or in arbitrary combinations as far as these combinations are not excluded expressively.

The invention is described further in the following with help of different embodiments as well as in comparison to the state of art. It is shown, each in a strongly schematic display, in.

DETAILED DESCRIPTION

In the figures, identical or similarly appearing elements are displayed with the same reference numbers.

Figure 1:
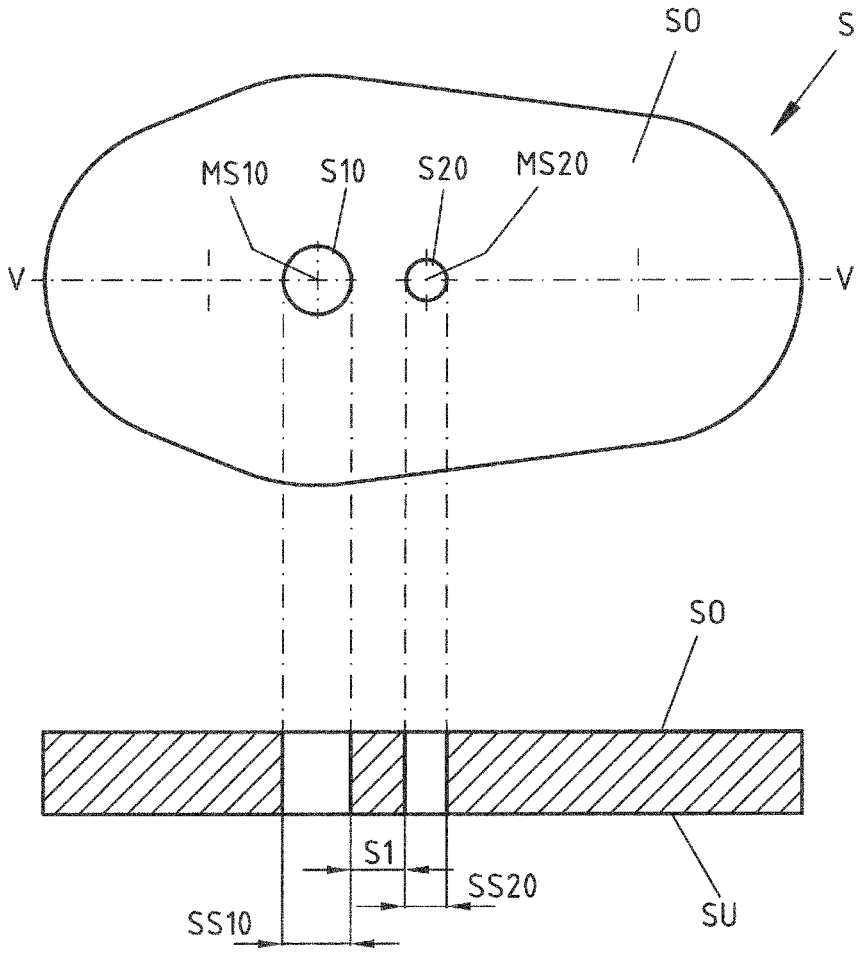
FIG. 1: A top view and across section through the sliding plate according to the invention.

FIG. 1 shows an inventive sliding plate S. which features an upper main surface SO and a lower main surface SU which runs parallel to the upper main surface, and which roughly features an oval shape in the top view (top in FIG. 1).

It is a sliding plate for a linear sliding closure, wherein the direction of displacement is marked with V-V. Two discharge openings S10, S20, each of which extends between the main surfaces SO, SU, to be specific at a distance S1 (where S1 is the shortest distance of the discharge openings S10, S20 along the direction of displacement V-V), lie along the direction of displacement V-V.

The larger discharge opening S10 features a diameter of SS10. The diameter of the smaller discharge opening S20 is labelled SS20.

Both discharge openings S10, S20 feature a constant circular cross section between the main surfaces SO, SU, while the corresponding central longitudinal axis are labelled as MS10, MS20.

Figure 2:
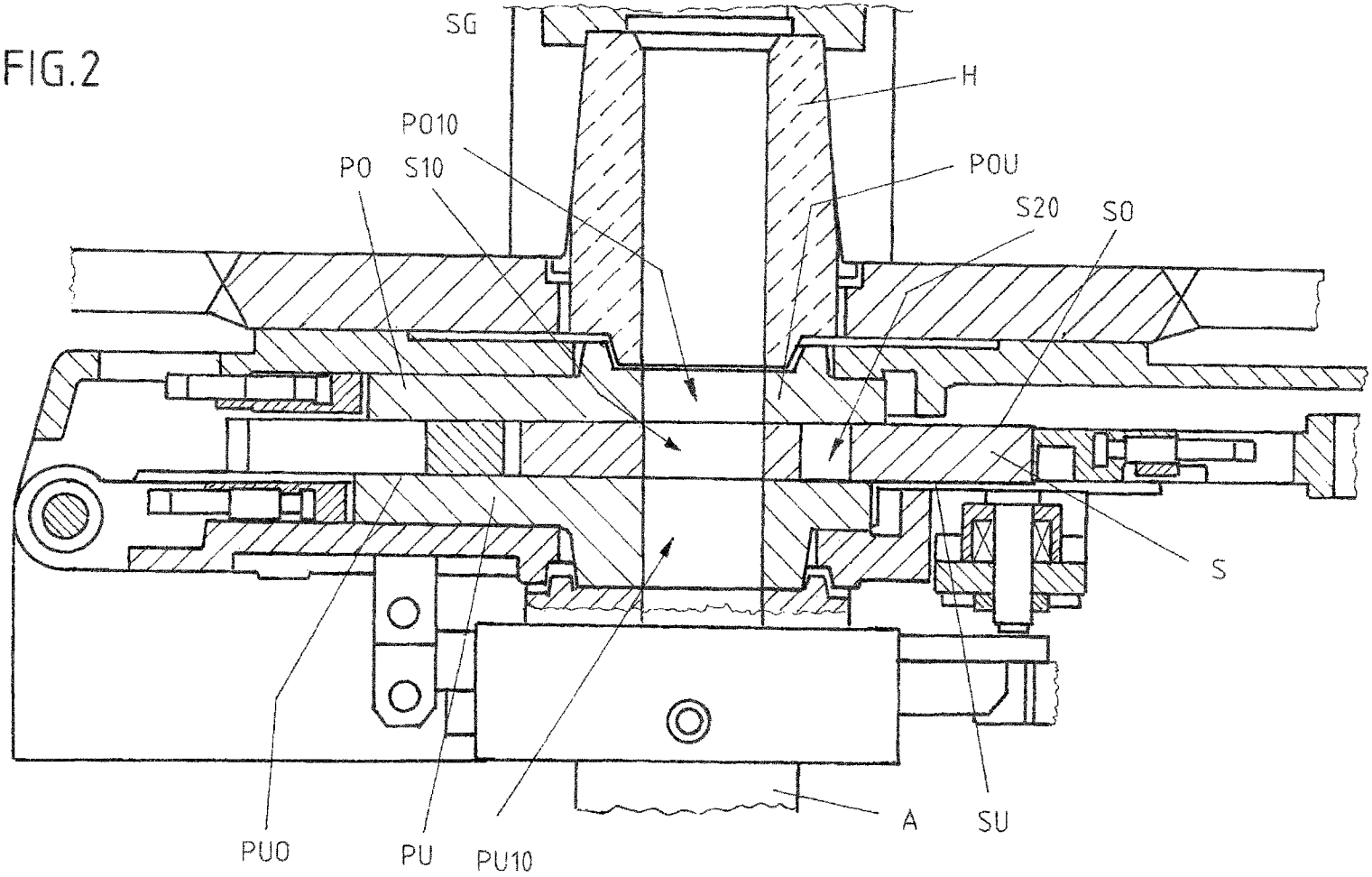
FIG. 2: A cross section through the sliding plate set according to the invention.

FIG. 2 shows the arrangement of such a sliding plate S in a 3 plate sliding closure. Hence, the corresponding sliding plate set comprises 3 plates, namely an upper, fixed plate PO and alower, fixed plate PU. The sliding plate S runs between both, or rather between the bottom side POU of the plate PO and the upper side PUO of the plate PU. The plates PO, PU each feature a discharge opening PO10, PU10, each with a circular cross section and the same dimensioning to the discharge opening S10 of the sliding plate S.

In the displayed position, all discharge opening PO10, S10, PU10 are aligned (flush to each other).

The smaller discharge opening S20 of the sliding plate S is covered by the plate PO from above and limited by the plate PV from below. In other words: in the displayed position, no metal melt flows through the discharge opening S20 from the melt vessel SG, which is arranged above, or rather from the assigned nottle H into downstream aggregates, which are only schematically labelled A here.

Further details of the sliding gate closure, like the cartridge intake (envelope) for the plates, the sliding mechanism for the sliding plate etc. are not explained further, because they are state or the art.

Figure 3:
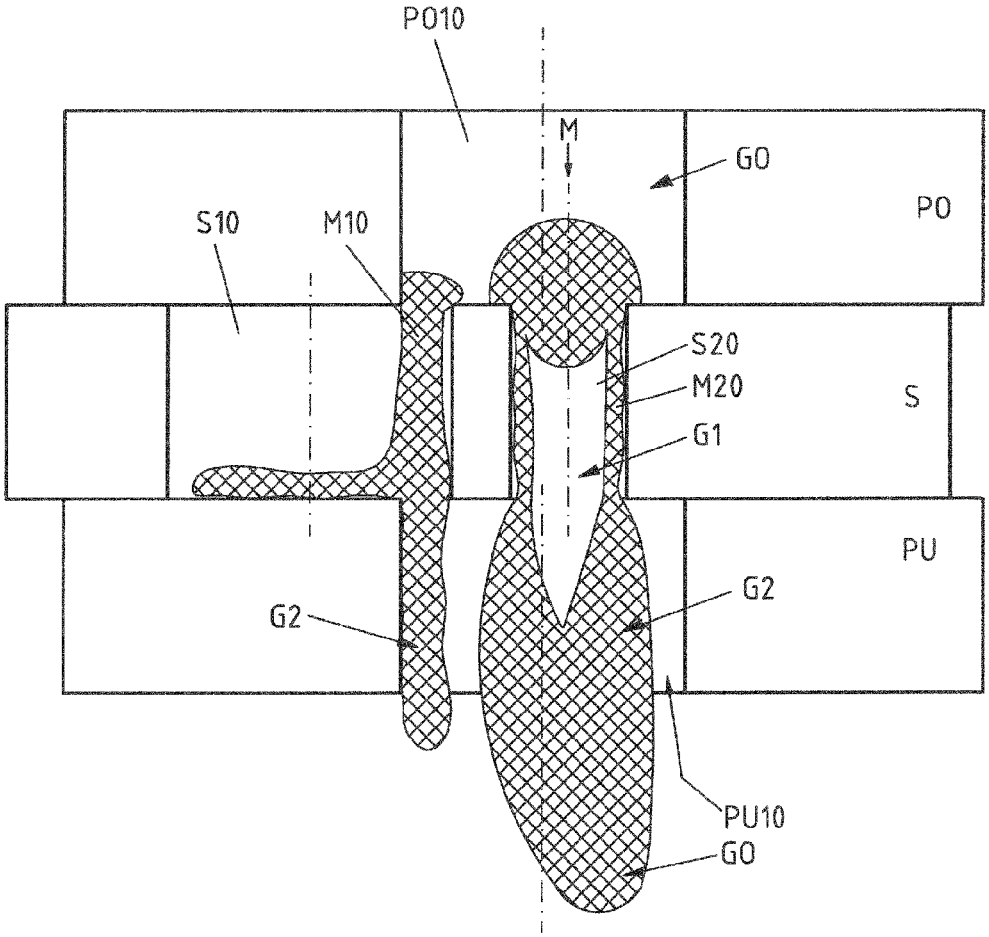
FIG. 3: An exemplary position of the sliding plate set according to FIG. 2.

FIG. 3 shows a position of the sliding plate S, which is moved to the left compared to the position according to FIG. 2 so that the smaller discharge opening S20 is fully in the area of the discharge opening PO10, but the larger discharge opening S10 is not yet fully removed from the overlap area with the discharge openings PO10, PU10. As a consequence, the stream of melt, schematically indicated as M, is split into two partial streams, as soon as the melt reached the area of the sliding plate S. These partial streams are indicated as M10, M20, and simultaneously corresponding stream profiles are displayed in a hachured manner.

While the melt features a speed G0 in the area of the discharge opening PO10, which it only reaches again, when the melt has left the lower plate PU, the partial stream M10 features approximately a speed G2, which is larger than G0. In the area of the smaller discharge opening S20, the stream profile is in such a way, that centrally an area is formed, where the stream speed is G1, which is larger than G2, where G2 is observed in the outer region of the melt stream M20. It is obvious that the transitions between the single speed readings are not gradual (stepwise), but continuous.

The illustration according to FIG. 3 shows that due to the central position of the discharge opening S20, the sucking in of air below the discharge opening PU10 is virtually impossible. If at all, a leftover amount of air can be sucked in into the transition area of the melt stream M10 between adjacent plates.

The arrangement according to the invention of both discharge openings of the sliding plate S therefore not only increases the controllability of the sliding plate net (the sliding closure), but also improves the quality of the metal melt that is led through in comparison to the state of art due to less oxidation.

Figure 4:
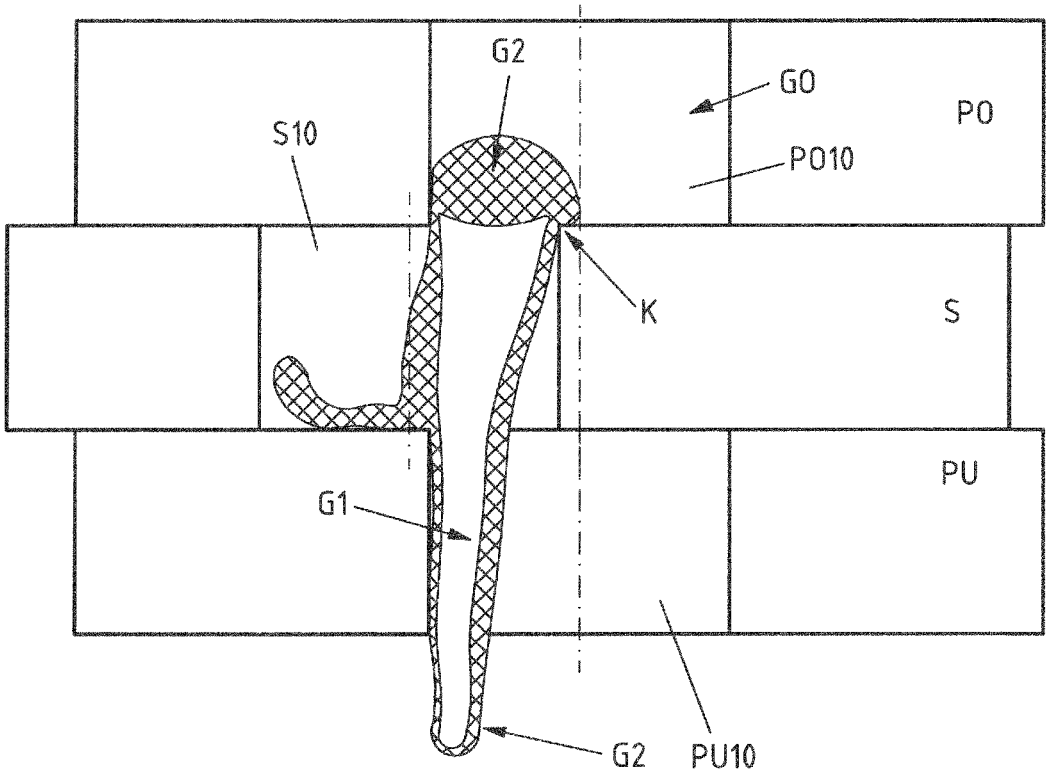
FIG. 4: A display analogue to FIG. 3 for a sliding plate set according to the state of the art.

The state of the art is displayed in FIG. 4. In that, all the discharge openings of all plates are identical. During a linear displacement of the sliding plate S, a reduction of the metal melt (reduction of the flow volume) does take place. Thus, the danger of undesired air infiltration in the transition area between two plates is simultaneously increased. It was also observed that in the area of the edge K of the sliding plate S a deflection of the stream and a highly increased stream speed of the metal melt are created, which causes a high corrosion and erosion. This can be avoided with the design according to the invention.

Figure 5:
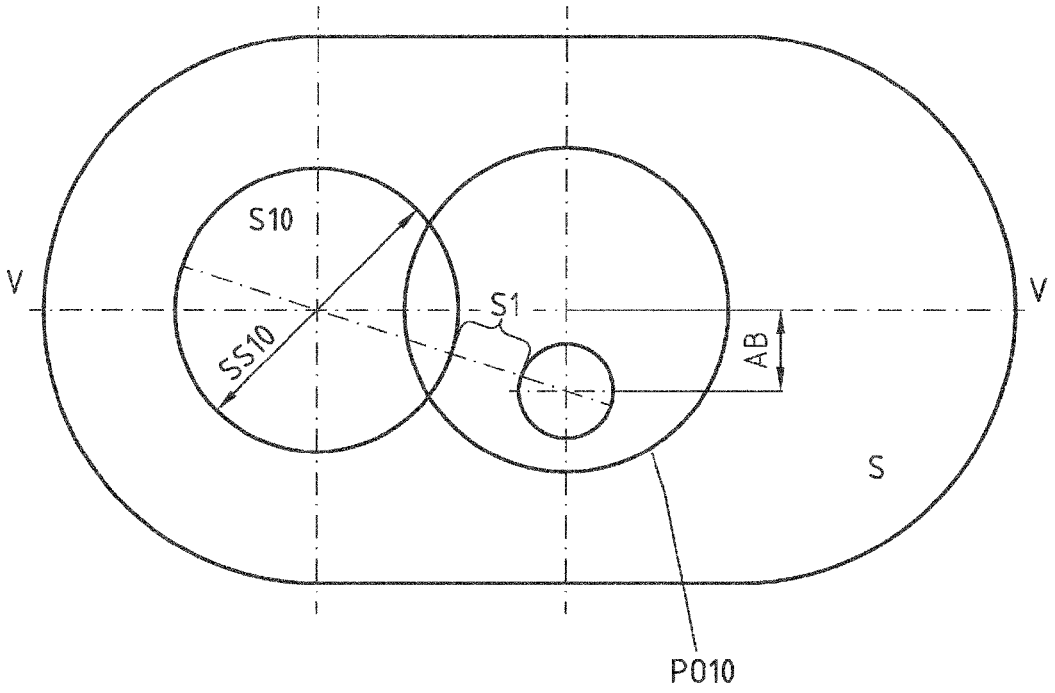
FIG. 5: A further embodiment for a sliding plate in arrangement with a further plate.

FIG. 5 shows a further embodiment of a linear sliding plate S. The diameter SS10 of the larger flow-through opening S10 is 60 mm, the diameter of the smaller flow-through opening S20 is 25 mm, the shortest distance s1 between both discharge openings S10, S20 is 15 mm. This is resulting in a cross sectional area of 2.827 $mm^2$ for the discharge opening S10, and for S20 a value of 491 $mm^2$. The opening PO10 of a neighbouring plate is indicated.

The value x for the aforementioned formula lies therefore around 0.83. The direction of displacement is labelled as V-V. The opening S20 is offset to the direction of displacement V-V (distance AB to the centre of the opening S20).

Figure 6:
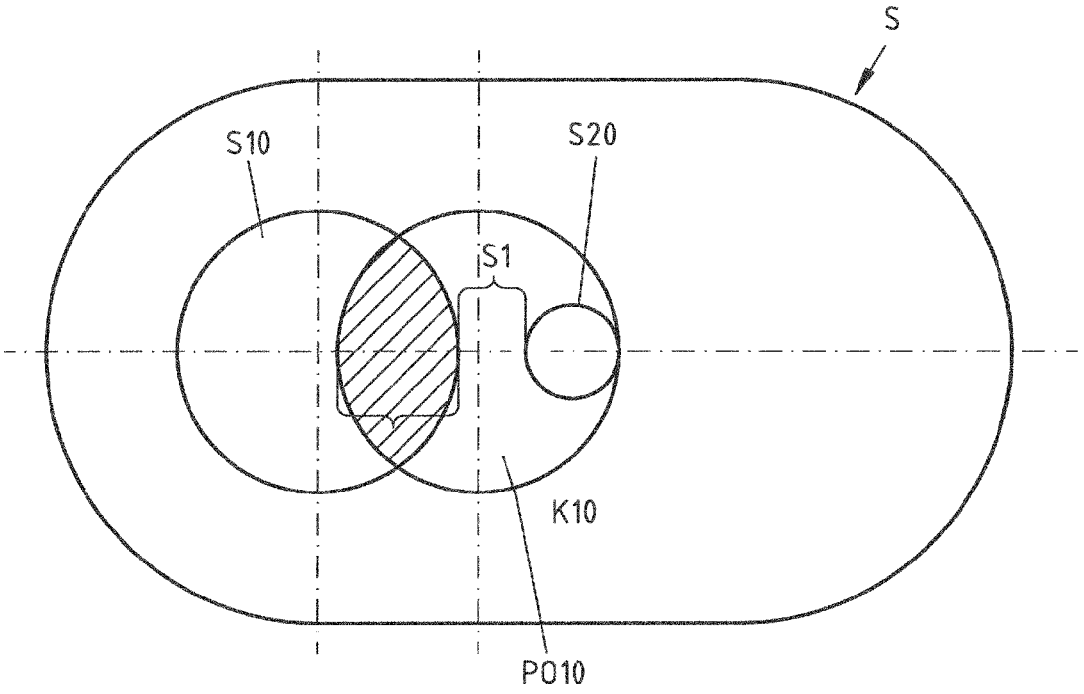
FIG. 6: A further embodiment for a sliding plate in arrangement with a further plate.

In FIG. 6 a linear sliding plate S with the following values is displayed: SS10=60 mm, SS20=25 mm. The diameter of the discharge opening PO10 is also 60 mm. The distance S1 is 17 mm.

The discharge opening S20 of the sliding plate S is respectively completely covered by the discharge opening PU10 in the displayed position, and around 21.9% of the discharge opening S10 of the sliding plate S is covered by the discharge opening PU10 in the displayed position.

Figure 7:
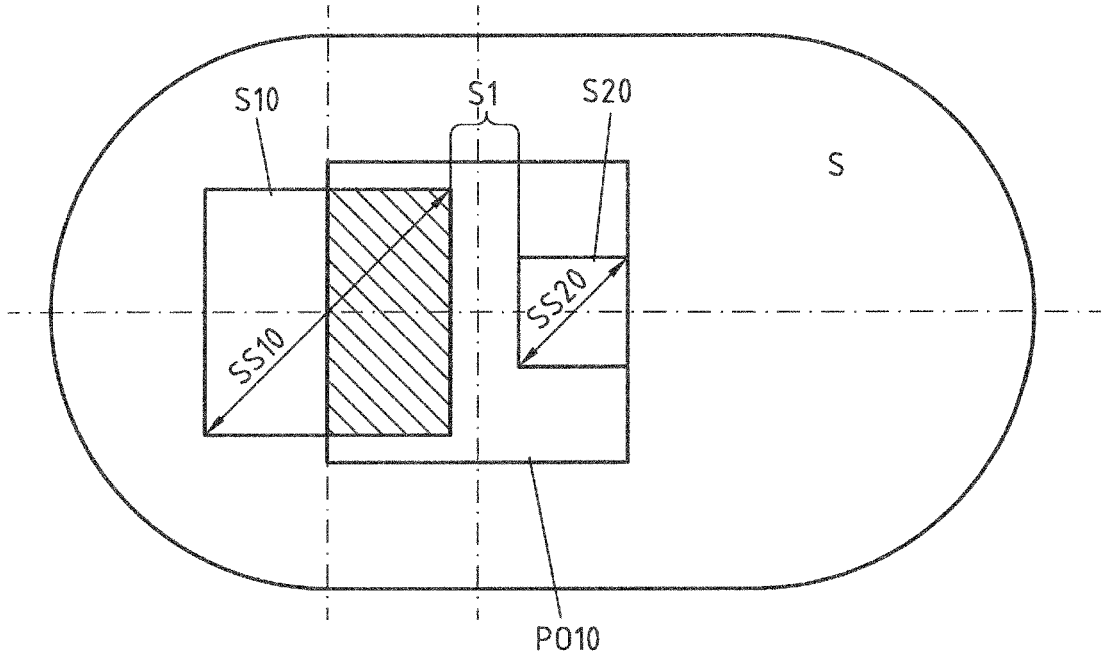
FIG. 7: A further embodiment for a sliding plate in arrangement with a further plate.

In FIG. 7, an embodiment similar to FIG. 6 is shown, where however the discharge openings do not feature a circular cross section, but a quadratic cross section each. It is easily recognizable that in the shown arrangement of the discharge openings of the upper plate PO and the sliding plate S, the degree of overlap with the smaller discharge opening S20 is 100% and the degree of overlap with the larger discharge opening S10 is 50%.

Figure 8:
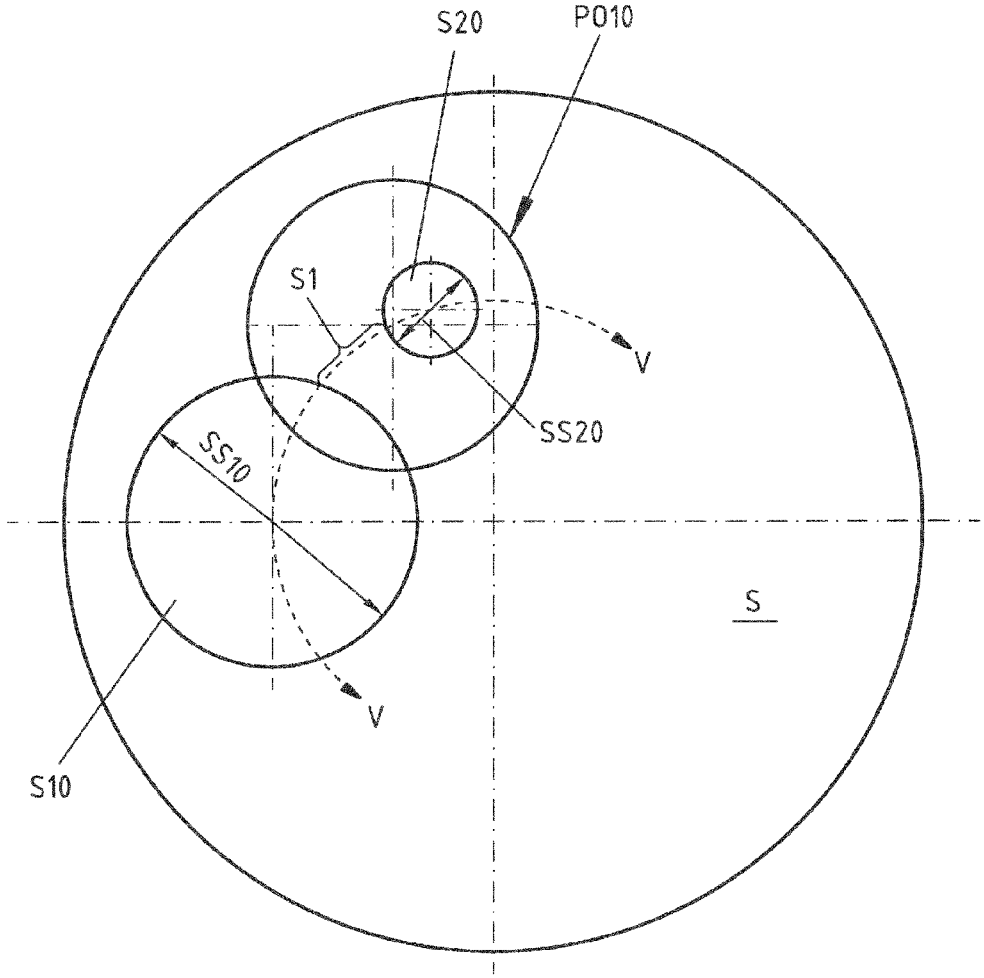
FIG. 8: A further embodiment for a rotary sliding closure in arrangement with a further plate.

FIG. 8 shows an illustration similar to FIG. 5, though for a rotary sliding closure, where the circular path of sliding is labelled V-V.

With a cross sectional area of $908^2$ for the discharge opening S20 and 7.854 $mm^2$ for the discharge opening S10 (the distance S1 is 30 mm), the result is a value x of approximately 0.88.

The sliding plate S can consist of a carbon bound material.

The invention claimed is:

1. A sliding plate set, comprising a sliding plate (S) and at least one further plate (PO, PU), each made of a fireproof ceramic material and each featuring two main surfaces, which run parallel to each other, for an aligned arrangement with their corresponding main surfaces in a use position of the sliding plate set, where the sliding plate (S) further includes at least two discharge openings (S10, S20), arranged at a distance to each other, wherein each of said discharge openings (S10, S20) extends between the main surfaces (SO, SU) of the sliding plate (S), and in the area of at least one main surface (SO, SU), said at least two discharge openings (S10, S20) have different cross sectional areas (QS10, QS20), and wherein the shortest distance (s1) between said at least two discharge openings (S10, S20) along said at least one main surface (SO, SU) is shorter than the largest diameter (SS10) of any of said at least two discharge openings (S10, S20), and the at least one further plate (PO, PU) features at least one discharge opening (PO10, PU10), wherein the cross sectional area and arrangement of this at least one discharge opening (PO10, PU10) of the at least one further plate (PO, PU) are chosen in such a way that the at least one discharge opening (PO10, PU10) of the at least one further plate (PO, PU) covers one or more of said at least two discharge openings (S10, S20) of the sliding plate (S) fully or partially, depending on the position of the sliding plate (S).

2. The sliding plate set according to claim 1, wherein the at least one discharge opening (PO10, PU10) of the further plate (PO, PU) has a cross sectional area and arrangement, that are chosen in such a way, that, depending on the position of the sliding plate (S), the at least one discharge opening (PO10, PU10) of the further plate (PO, PU) either covers the discharge opening (S20) of the sliding plate (S) with a smaller cross sectional area or covers the discharge opening (S20) of the sliding plate (S) with a small cross sectional area (QS20) and at the same time up to 50% of the discharge opening (S10) of the sliding plate with a larger cross sectional area (QS10).

3. The sliding plate set according to claim 1, wherein centres (MS10, MS20, MK10) of all discharge openings (S10, S20, PO10, PU10) along corresponding main surfaces (POU, SO; SU, PUO) lie on a common level, which runs perpendicular to the main surfaces (SU, SO).

* * * * *